US010502245B2

(12) United States Patent
Reuter et al.

(10) Patent No.: US 10,502,245 B2
(45) Date of Patent: Dec. 10, 2019

(54) ACTUATOR COOLING FLOW LIMITER

(71) Applicant: Hamilton Sundstrand Corporation, Charlotte, NC (US)

(72) Inventors: Charles E. Reuter, Granby, CT (US); Richard H. Bostiga, Ellington, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 136 days.

(21) Appl. No.: 15/689,635

(22) Filed: Aug. 29, 2017

(65) Prior Publication Data

US 2019/0063475 A1 Feb. 28, 2019

(51) Int. Cl.
*F15B 11/024* (2006.01)
*F15B 21/042* (2019.01)
(Continued)

(52) U.S. Cl.
CPC ..... *F15B 21/042* (2013.01); *F01D 17/26* (2013.01); *F15B 11/08* (2013.01); *F15B 13/042* (2013.01); *F15B 15/1485* (2013.01); *F05D 2260/20* (2013.01); *F05D 2260/606* (2013.01); *F05D 2270/64* (2013.01); *F15B 11/024* (2013.01); *F15B 13/021* (2013.01); *F15B 13/0401* (2013.01); *F15B 15/149* (2013.01); *F15B 15/1428* (2013.01); *F15B 2011/0246* (2013.01); *F15B 2211/205* (2013.01); *F15B 2211/3058* (2013.01); *F15B 2211/62* (2013.01); *F15B 2211/7051* (2013.01)

(58) Field of Classification Search
CPC ..... F15B 11/024; F15B 2011/0243; F15B 2011/0246; F15B 2211/41536; F15B 2211/5154; F15B 2211/62
See application file for complete search history.

(56) References Cited

U.S. PATENT DOCUMENTS 2,431,032 A * 11/1947 Ernst ..... F15B 11/022 91/420
4,145,959 A * 3/1979 Burden ..... F15B 11/076 137/504

(Continued)

FOREIGN PATENT DOCUMENTS

| | | | |
|---|---|---|---|
| FR | 2959782 | A1 | 11/2011 |
| JP | S6030803 | A | 2/1985 |
| JP | 2002031101 | A | 1/2002 |

OTHER PUBLICATIONS

Search Report dated Jan. 18, 2019 in U380944EP, EP Application No. 18180383.4, 8 pages.

*Primary Examiner* — F Daniel Lopez
(74) *Attorney, Agent, or Firm* — Cantor Colburn LLP

(57) ABSTRACT

A cooling flow circuit is provided and includes a main line having first and second sections ported to piston extend and return sides of the gas turbine engine actuator, respectively, an orifice disposed along the main line between the first and second sections, a bypass line and a bypass valve. The bypass line is fluidly coupled to the first and second sections at opposite ends thereof, respectively. The bypass valve is disposed along the bypass line between the opposite ends thereof. The bypass valve has a variable flow area which is responsive to a pressure differential between the first and second sections.

10 Claims, 5 Drawing Sheets

(51) Int. Cl.

| | |
|---|---|
| ***F15B 11/08*** | (2006.01) |
| ***F15B 13/042*** | (2006.01) |
| ***F01D 17/26*** | (2006.01) |
| ***F15B 15/14*** | (2006.01) |
| *F15B 13/04* | (2006.01) |
| *F15B 13/02* | (2006.01) |

(56) References Cited

U.S. PATENT DOCUMENTS

| | | | | |
|---|---|---|---|---|
| 7,448,309 | B2 * | 11/2008 | Bitter | B66F 9/065 91/418 |
| 9,404,411 | B2 | 8/2016 | Matthews | |
| 9,429,036 | B2 | 8/2016 | Aguilar | |

* cited by examiner

ACTUATOR COOLING FLOW LIMITER

STATEMENT OF GOVERNMENT RIGHTS

This invention was made with government support under contract number FA8626-16-C-2139 awarded by the U.S. Department of Defense. The government has certain rights in the invention.

BACKGROUND

The following description relates to actuators and, more specifically, to cooling flow limiters of gas turbine engine actuators.

Gas turbine engine actuators often operate in hot environments and thus can be subject to high temperature and fire resistance requirements that need to be met. A typical mitigation solution for complying with such requirements is with a provision for quiescent cooling flow to a slave actuator (i.e., an actuator with an electro-hydraulic servo valve (EHSV) controller located remotely from the actuator) but doing so can be challenging. This is due to the fact that because a pressure differential that is available to drive the cooling flow is the differential between extend and retract pressures and, depending on actuator loads, this differential can vary by a large amount. A cooling flow orifice must therefore be sized for the lowest expected or actual pressure differential that may be experienced and as a result tends to permit excess cooling flow at higher differentials. This results in a parasitic flow loss and system heating.

BRIEF DESCRIPTION

According to an aspect of the disclosure, a cooling flow circuit is provided and includes a main line having first and second sections ported to piston extend and return sides of the gas turbine engine actuator, respectively, an orifice disposed along the main line between the first and second sections, a bypass line and a bypass valve. The bypass line is fluidly coupled to the first and second sections at opposite ends thereof, respectively. The bypass valve is disposed along the bypass line between the opposite ends thereof. The bypass valve has a variable flow area which is responsive to a pressure differential between the first and second sections.

In accordance with additional or alternative embodiments, the orifice is sized for a non-minimal pressure differential between the first and second sections.

In accordance with additional or alternative embodiments, the bypass line is disposed in parallel with the main line and the bypass valve is disposed in parallel with the orifice.

In accordance with additional or alternative embodiments, the bypass valve includes a first valve opening which is fluidly coupled to one end of the bypass line, a second valve opening which is fluidly coupled to the other end of the bypass line and a valve element which is elastically biased to move between open and closed positions relative to the first and second valve openings in response to the pressure differential.

In accordance with additional or alternative embodiments, springs are provided by which the valve element is anchored to the first and second valve openings and by which the valve element is elastically biased.

According to another aspect of the disclosure, an actuation system is provided and includes an actuator. The actuator includes a piston and a housing cooperatively defining first and second interiors on extend and retract sides of the piston. The housing further defines a main line by which the first and second interiors are fluidly communicative. The actuation system further includes a fluid source, a remote servo valve fluidly interposed between the actuator and the fluid source and a flow circuit. Fluid supplied from the fluid source is exclusively provided to the first and second interiors from the remote servo valve. The flow circuit is coupled to the main line and has a variable flow area through which fluid is permitted to flow between the first and second interiors. The variable flow area is variable in response to a pressure differential between the first and second interiors.

In accordance with additional or alternative embodiments, the fluid source includes a pump.

In accordance with additional or alternative embodiments, the actuation system further includes additional secondary piping by which the fluid supplied from the fluid source is moved from the pump to the remote servo valve and additional tertiary piping by which the fluid supplied from the fluid source is returned to the pump from the remote servo valve.

In accordance with additional or alternative embodiments, the remote servo valve is displaced from the housing.

In accordance with additional or alternative embodiments, the flow circuit includes first and second sections of the main line, an orifice disposed along the main line between the first and second sections, a bypass line fluidly coupled to the first and second sections at opposite ends thereof, respectively, and a bypass valve disposed along the bypass line between the opposite ends thereof and having a variable valve flow area which is responsive to a pressure differential between the first and second sections.

In accordance with additional or alternative embodiments, the orifice is sized for a non-minimal pressure differential between the first and second sections.

In accordance with additional or alternative embodiments, the bypass line is disposed in parallel with the main line and the bypass valve is disposed in parallel with the orifice.

In accordance with additional or alternative embodiments, the bypass valve includes a first valve opening which is fluidly coupled to one end of the bypass line, a second valve opening which is fluidly coupled to the other end of the bypass line and a valve element which is elastically biased to move between open and closed positions relative to the first and second valve openings in response to the pressure differential.

In accordance with additional or alternative embodiments, springs are provided by which the valve element is anchored to the first and second valve openings and by which the valve element is elastically biased.

According to yet another aspect of the disclosure, a gas turbine engine actuation system is provided and includes an actuator. The actuator includes a piston and a housing cooperatively defining first and second interiors on extend and retract sides of the piston. The piston is movable between extend and retract positions responsive to pressures within the first and second interiors and the housing further defines a main line by which the first and second interiors are fluidly communicative. The gas turbine engine actuation system further includes a pump, a remote servo valve physically displaced from the housing and fluidly interposed between the actuator and the pump and a flow circuit. Fluid supplied from the pump is exclusively provided to the first and second interiors from the remote servo valve. The flow circuit is coupled to the main line and has a variable flow area through which fluid is permitted to flow between the first and second interiors. The variable flow area is variable in response to a pressure differential between the first and second interiors.

In accordance with additional or alternative embodiments, the gas turbine engine actuation system further includes additional secondary piping by which the fluid supplied from the pump is pumped to the remote servo valve and additional tertiary piping by which the fluid supplied from the pump is returned thereto from the remote servo valve.

In accordance with additional or alternative embodiments, the remote servo valve is displaced from the housing.

In accordance with additional or alternative embodiments, the flow circuit includes first and second sections of the main line, an orifice disposed along the main line between the first and second sections, a bypass line fluidly coupled to the first and second sections at opposite ends thereof, respectively, and a bypass valve disposed along the bypass line between the opposite ends thereof and having a variable valve flow area which is responsive to a pressure differential between the first and second sections.

In accordance with additional or alternative embodiments, the orifice is sized for a non-minimal pressure differential between the first and second sections.

In accordance with additional or alternative embodiments, the bypass line is disposed in parallel with the main line and the bypass valve is disposed in parallel with the orifice.

In accordance with additional or alternative embodiments, the bypass valve includes a first valve opening which is fluidly coupled to one end of the bypass line, a second valve opening outlet which is fluidly coupled to the other end of the bypass line and a valve element which is elastically biased to move between open and closed positions relative to the first and second valve openings in response to the pressure differential.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, reductions in flow losses in a cooling flow limiter of a gas turbine engine actuator are provided for. A cooling flow limiting hydraulic circuit includes a flow limiting valve in parallel with an orifice. A pressure differential between an extend pressure (e.g., a pressure on a piston/extend side of the actuator) and a retract pressure (e.g., a pressure on a retract/rod side of the actuator) is sensed across the circuit in either of first and second directions. When the pressure differential is low due to low load conditions, for example, cooling flow is permitted through both the orifice and the flow limiting valve. As the pressure differential increases in correspondence with load increases, the flow limiting valve closes and flow is permitted through the orifice alone. That is, the flow limiting valve closes whenever the absolute value of the difference between the extend pressure and the retract pressure exceeds a minimum pressure differential value. The total flow area of the orifice and the flow limiting valve can thus be sized to provide sufficient cooling flow at a minimum pressure differential value and when the pressure differential value is above the closing pressure of the flow limiting valve.

Figure 1:
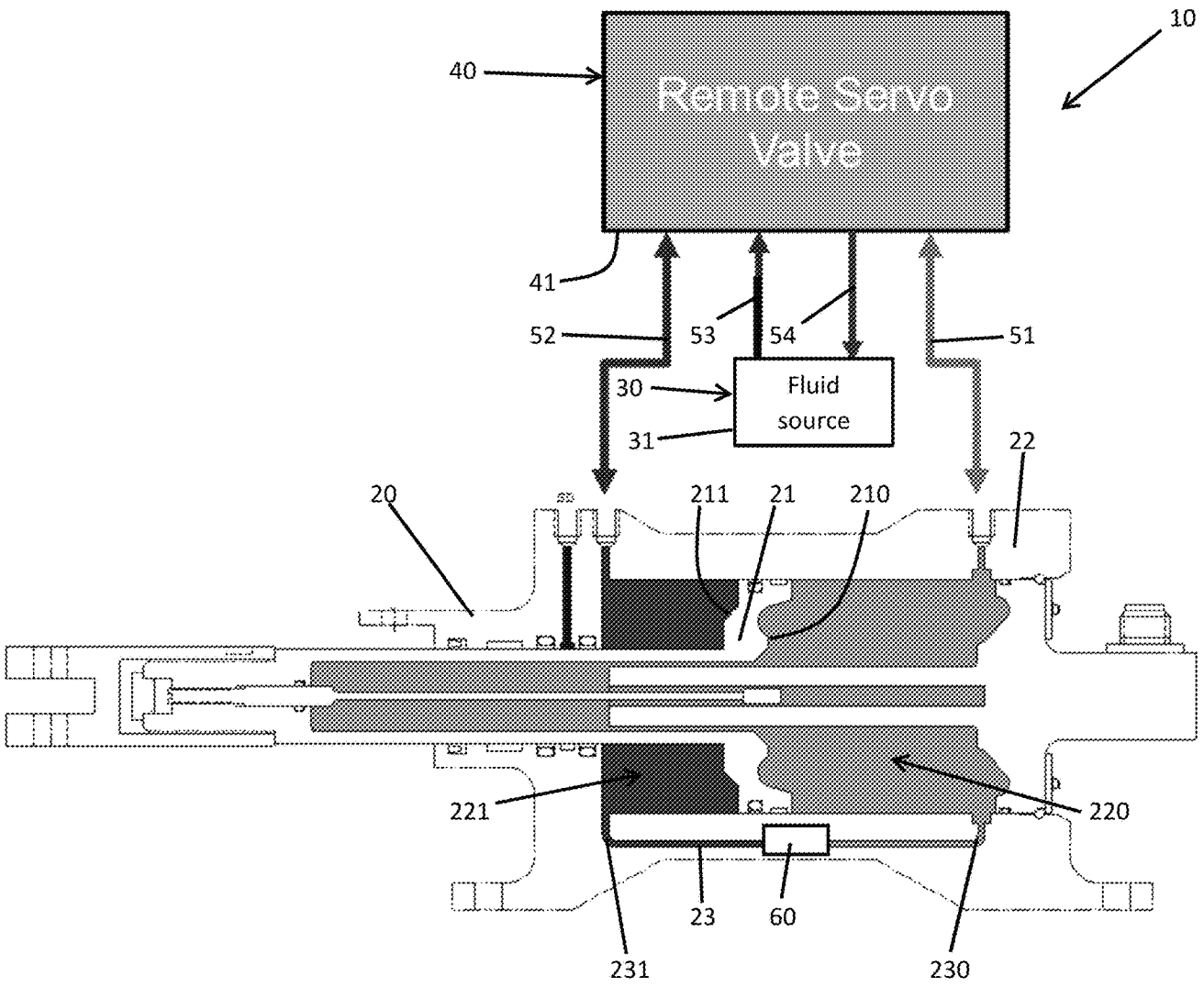
FIG. 1 is a schematic illustration of a gas turbine engine actuation system in accordance with embodiments.
Figure 2:
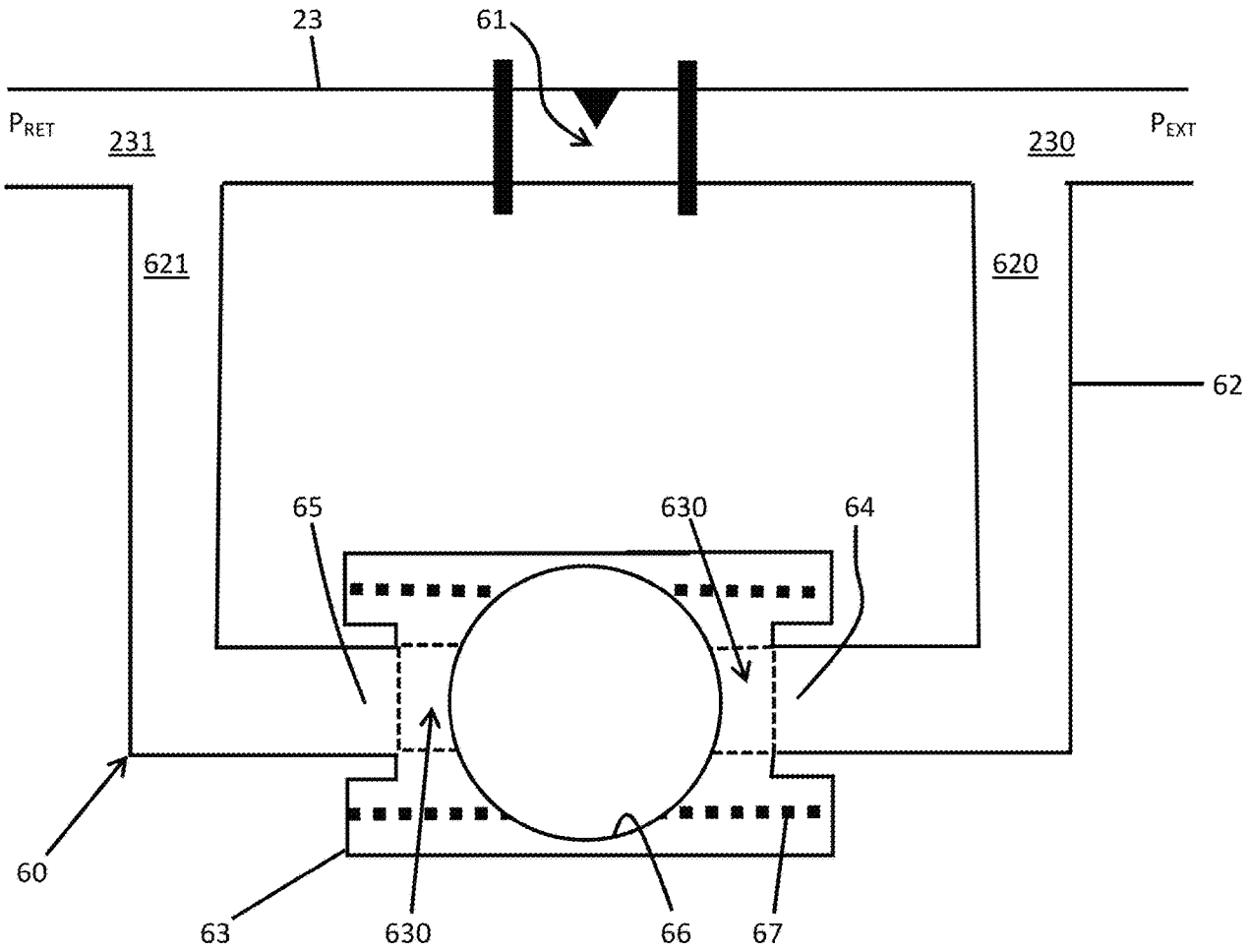
FIG. 2 is a schematic illustration of a cooling flow circuit of the gas turbine engine actuation system of FIG. 1 while operating under relatively low load conditions.
Figure 3:
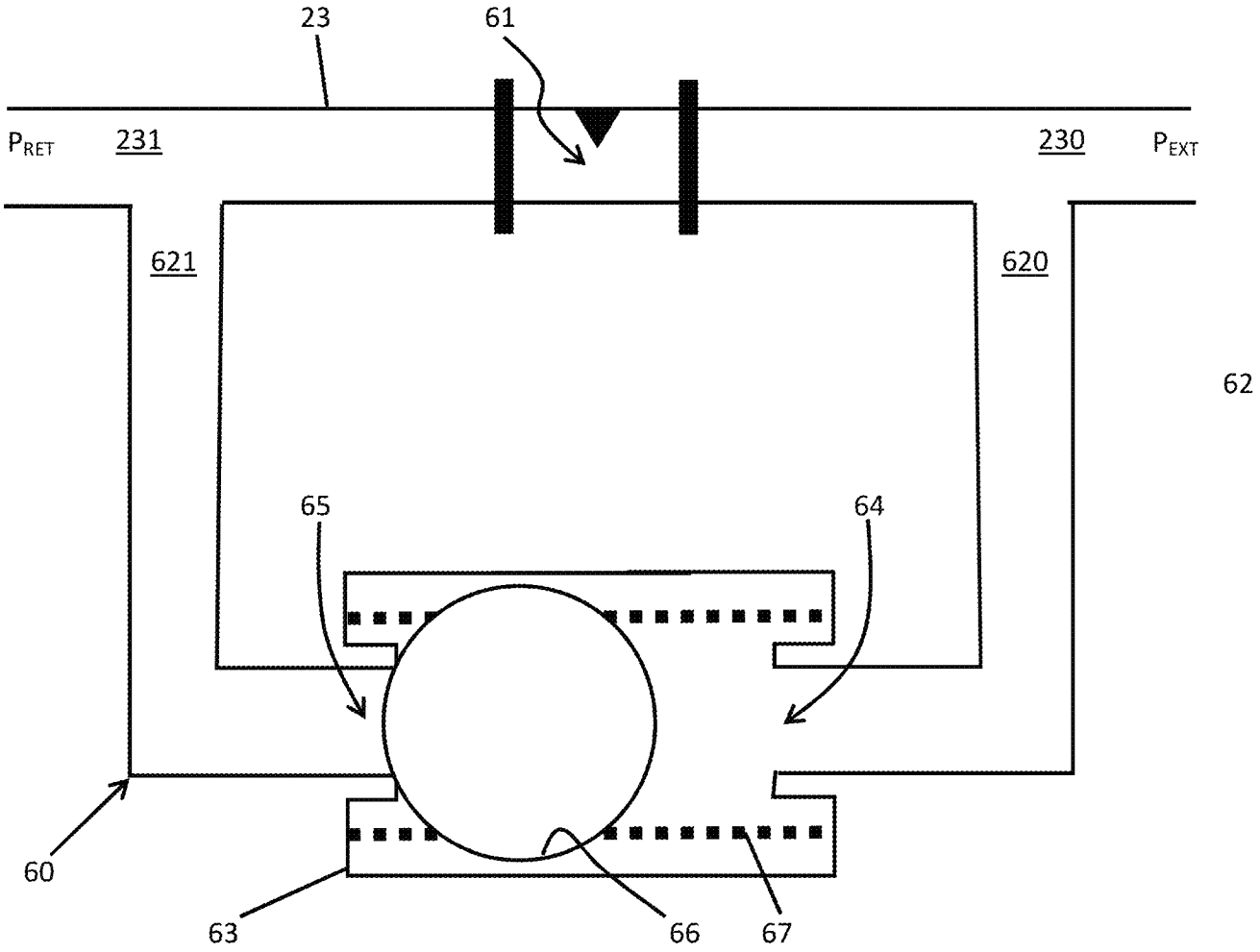
FIG. 3 is a schematic illustration of the cooling flow circuit of the gas turbine engine actuation system of FIG. 1 while operating under relatively high load conditions.

With reference to FIGS. 1, 2 and 3, a gas turbine engine actuation system (hereinafter referred to as an "actuation system") 10 is provided.

As shown in FIG. 1, the actuation system 10 includes an actuator 20, a fluid source 30, a remote servo valve 40, first and second piping 51 and 52 and a flow circuit 60. The actuator 20 includes a piston 21 and a housing 22. The piston 21 is disposed within the housing 22 and is movable within the housing 22 between an extend position and a retract position. The piston 21 has an extend side 210 and a retract side 211. The piston 21 and the housing 22 cooperatively define a first interior 220 between the extend side 210 and a corresponding interior surface of the housing 22 and a second interior 221 between the retract side 211 and a corresponding interior surface of the housing 22.

The movement of the piston 21 between extend and retract positions is responsive to pressures of fluids contained within the first and second interiors 220 and 221. That is, when fluid pressures within the first interior 220 have a greater magnitude than the fluid pressures within the second interior 221, the resulting pressure differential causes the piston 21 to move toward the extend position. By contrast, when fluid pressures within the second interior 221 have a greater magnitude than the fluid pressures within the first interior 220, the resulting pressure differential causes the piston 21 to move toward the retract position.

The housing 22 is further formed to define a main line 23. The main line 23 is generally tubular and has a first section 230 and a second section 231. The first section 230 is ported to the first interior 220. The second section 231 is fluidly coupled to the first section 230 and is ported to the second interior 221. As such, the first and second interiors 220 and 221 are fluidly communicative with each other in either of two directions by way of the first and second sections 230 and 231 of the main line 23.

The fluid source 30 may be provided as a pump 31 or as another similar fluid movement element. The remote servo valve 40 includes a housing 41 that is physically displaced from the housing 22 of the actuator 20 and is fluidly interposed between the actuator 22 and the fluid source 30.

Fluid supplied from the fluid source 30 is exclusively provided to the first and second interiors 220 and 221 from the remote servo valve 40 and not from the fluid source 30 by way of the first and second piping 51 and 52, respectively. The fluid supplied from the fluid source 30 is moved or pumped from the fluid source 30 to the remote servo valve 40 and not to the first and second interiors 220 and 221 by way of additional secondary piping 53 and the fluid supplied from the fluid source 30 is returned to the fluid source 30 from the remote servo valve 40 by way of additional tertiary piping 54.

The flow circuit 60 is coupled to the main line 23 and has a variable flow area through which fluid is permitted to flow between the first and second interiors 220 and 221. The variable flow area is variable in response to a pressure differential between the first and second interiors 220 and 221.

As shown in FIGS. 2 and 3, the flow circuit 60 includes an orifice 61, which is disposed along the main line 23 at an axial location between the first section 230, which has an internal fluid pressure $P_{EXT}$ that corresponds to the fluid pressure within the first interior 220, and the second section 231, which has an internal fluid pressure $P_{RET}$ that corresponds to the fluid pressure within the second interior 221. The flow circuit 60 further includes a bypass line 62 that is disposed in parallel with the main line 23 and a bypass valve 63 that is disposed in parallel with the orifice 61. The bypass line 62 has two ends 620 and 621 thereof and is fluidly coupled to the first section 230 at one end 620 of the bypass line 62 and to the second section 231 at the other end 621 of the bypass line 62. The bypass valve 63 is disposed along the bypass line 62 between the ends 620 and 621 thereof and has a variable valve flow area 630 (see FIG. 2) which could be defined on either or both sides of the bypass valve 63.

The variable valve flow area 630 is responsive to a pressure differential between the first section 230 (i.e., $P_{EXT}$) and the second section 231 (i.e., $P_{RET}$).

In accordance with embodiments, the orifice 61 may be sized for a non-minimal pressure differential between the first section 230 (i.e., $P_{EXT}$) and the second section 231 (i.e., $P_{RET}$). By contrast, in conventional systems, a similar orifice would be sized for a minimal pressure differential associated with low load conditions and would have a substantially larger size as compared to that of the orifice 61. The relatively small size of the orifice 61 thus provides for reduced leakage or flow losses and permits a size or capacity of the fluid source 30 to be reduced.

In accordance with embodiments, the bypass valve 63 includes a first valve opening 64, a second valve opening 65, a valve element 66 and an elastic element 67. The first valve opening 64 is fluidly coupled to one end 620 of the bypass line 62. The second valve opening 65 is fluidly coupled to the other end 621 of the bypass line 62. The valve element 66 may be provided as a plug or another similar feature and is elastically biased to move between open and closed positions relative to the first and second valve openings 64 and 65 in response to the pressure differential. The elastic element 67 serves to anchor the valve element 66 to the first and second valve openings 64 and 65 and may be provided as a spring.

As shown in FIG. 2, the elastic element 67 is configured such that at relatively low load conditions of the actuator 20 where an absolute value of the pressure differential between the first section 230 (i.e., $P_{EXT}$) and the second section 231 (i.e., $P_{RET}$) is correspondingly relatively low I neither direction, the elastic element 67 will position the valve element 65 in the open position. Here, fluid can flow as coolant from the first interior 220 to the second interior 221 through the total flow area of the flow circuit 60. This total flow area includes the flow area of the orifice 61, which is fixed, and the flow area of the bypass valve 63, which is variable but at maximum or a relatively large size to compensate for the reduced size of the orifice.

As shown in FIG. 3, the elastic element 67 is configured such that at relatively high load conditions of the actuator 20 where an absolute value of the pressure differential between the first section 230 (i.e., $P_{EXT}$) and the second section 231 (i.e., $P_{RET}$) is correspondingly relatively high in either direction, the elastic element 67 will position the valve element 65 in the closed position. Here, fluid can flow as coolant from the first interior 220 to the second interior 221 only through the flow area of the orifice 61, which is fixed at the reduced size to avoid excessive leakage and flow losses.

It is to be understood that the flow directions shown in FIGS. 2 and 3 and described herein can be reversed whereby fluid can flow from the first interior 220 to the second interior 221 at low or high load conditions (i.e., $P_{EXT}>P_{RET}$) or from the second interior 221 to the first interior 220 at low or high load conditions (i.e., $P_{RET}>P_{EXT}$). In either case, an operation of the flow circuit 60 is substantially similar as to the operations already described herein.

Figure 4:
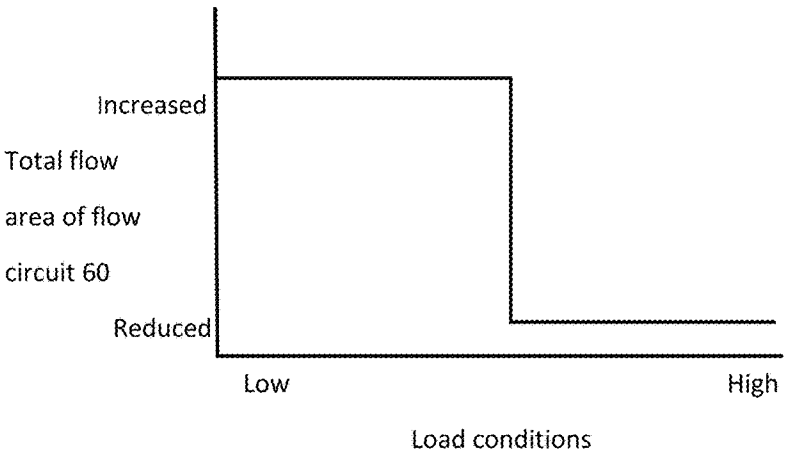
FIG. 4 is a graphical illustration of a step-wise relationship between a total flow area of the cooling flow circuit of FIGS. 2 and 3 and load conditions in accordance with embodiments.
Figure 5:
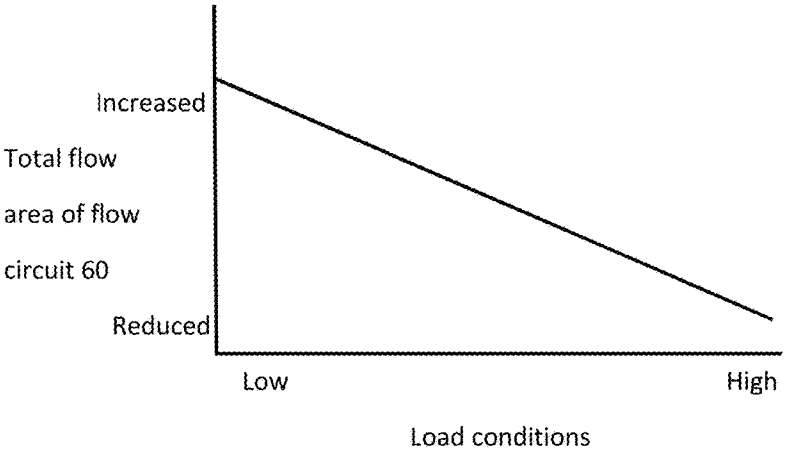
FIG. 5 is a graphical illustration of a linear relationship between a total flow area of the cooling flow circuit of FIGS. 2 and 3 and load conditions in accordance with embodiments.
Figure 6:
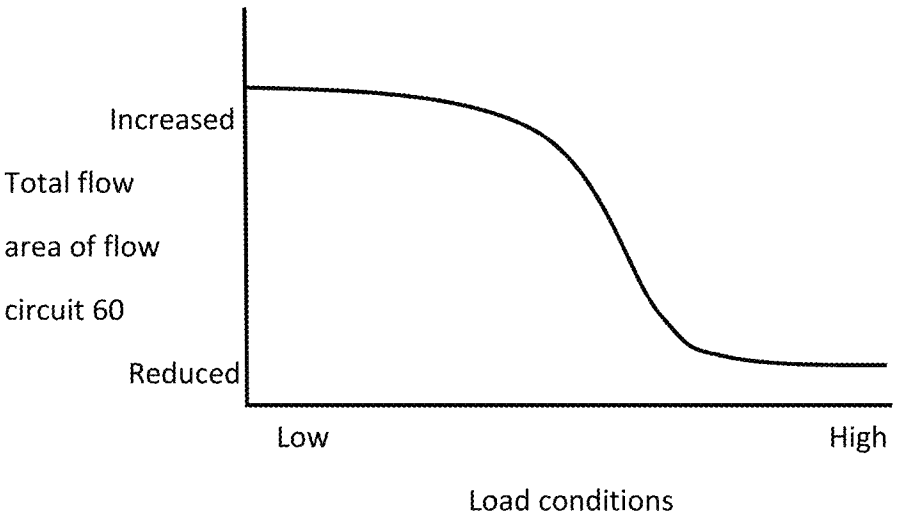
FIG. 6 is a graphical illustration of a non-liner relationship between a total flow area of the cooling flow circuit of FIGS. 2 and 3 and load conditions in accordance with embodiments.

With reference to FIGS. 4-6, a relationship between the total flow area of the flow circuit 60 and the relative load conditions of the actuator 20 is illustrated. As shown in FIG. 4 and as noted herein, the total flow area of the flow circuit 60 is variable and generally decreases with increased load conditions. In accordance with embodiments, the elastic element 67 may be configured such that the decrease in the total flow area of the flow circuit 60 is a step-wise function (see FIG. 4), linear (see FIG. 5) or non-linear (see FIG. 6).

The cooling flow limiter described herein allows for a reduced pump size and provides for re-circulated cooling flows. This reduces hydraulic system power requirements and removes heat from the hydraulic system.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A cooling flow circuit, comprising:

a main line having first and second sections ported to piston extend and return sides of a gas turbine engine actuator, respectively;

an orifice disposed along the main line between the first and second sections;

a bypass line fluidly coupled to the first and second sections at opposite ends thereof, respectively; and a bypass valve disposed along the bypass line between the opposite ends thereof and having a variable flow area which is responsive to a pressure differential between the first and second sections, wherein the bypass valve comprises a first valve opening which is fluidly coupled to one end of the bypass line, a second valve opening which is fluidly coupled to the other end of the bypass line, a valve element and springs by which the valve element is anchored to the first and second valve openings and by which the valve element is elastically biased to move between open and closed positions relative to the first and second valve openings in response to the pressure differential.

2. The cooling flow circuit according to claim 1, wherein the orifice is sized for a non-minimal pressure differential between the first and second sections.

3. An actuation system, comprising:

an actuator comprising a piston and a housing cooperatively defining first and second interiors on extend and retract sides of the piston, the housing further defining a main line by which the first and second interiors are fluidly communicative;

a fluid source;

a remote servo valve fluidly interposed between the actuator and the fluid source, fluid supplied from the fluid source being exclusively provided to the first and second interiors from the remote servo valve; and a flow circuit coupled to the main line and having a variable flow area through which fluid is permitted to flow between the first and second interiors, the variable flow area being variable in response to a pressure differential between the first and second interiors, wherein the flow circuit comprises first and second sections of the main line, an orifice disposed along the main line between the first and second sections, a bypass line fluidly coupled to the first and second sections at opposite ends thereof, respectively, and a bypass valve disposed along the bypass line between the opposite ends thereof and having a variable valve flow area which is responsive to a pressure differential between the first and second sections, and wherein the bypass valve comprises a first valve opening which is fluidly coupled to one end of the bypass line, a second valve opening which is fluidly coupled to the other end of the bypass line, a valve element and springs by which the valve element is anchored to the first and second valve openings and by which the valve element is elastically biased to move between open and closed positions relative to the first and second valve openings in response to the pressure differential.

4. The actuation system according to claim 3, wherein the fluid source comprises a pump.

5. The actuation system according to claim 4, further comprising:

additional secondary piping by which the fluid supplied from the fluid source is moved from the pump to the remote servo valve; and additional tertiary piping by which the fluid supplied from the fluid source is returned to the pump from the remote servo valve.

6. The actuation system according to claim 3, wherein the remote servo valve is displaced from the housing.

7. The actuation system according to claim 3, wherein the orifice is sized for a non-minimal pressure differential between the first and second sections.

8. A gas turbine engine actuation system, comprising:

an actuator comprising a piston and a housing cooperatively defining first and second interiors on extend and retract sides of the piston, the piston being movable between extend and retract positions responsive to pressures within the first and second interiors, and the housing further defining a main line by which the first and second interiors are fluidly communicative;

a pump;

a remote servo valve physically displaced from the housing and fluidly interposed between the actuator and the pump, fluid supplied from the pump being exclusively provided to the first and second interiors from the remote servo valve; and a flow circuit coupled to the main line and having a variable flow area through which fluid is permitted to flow between the first and second interiors, the variable flow area being variable in response to a pressure differential between the first and second interiors, wherein the flow circuit comprises first and second sections of the main line, an orifice disposed along the main line between the first and second sections, a bypass line fluidly coupled to the first and second sections at opposite ends thereof, respectively, and a bypass valve disposed along the bypass line between the opposite ends thereof and having a variable valve flow area which is responsive to a pressure differential between the first and second sections, wherein the bypass valve comprises a first valve opening which is fluidly coupled to one end of the bypass line, a second valve opening which is fluidly coupled to the other end of the bypass line, a valve element and springs by which the valve element is anchored to the first and second valve openings and by which the valve element is elastically biased to move between open and closed positions relative to the first and second valve openings in response to the pressure differential.

9. The gas turbine engine actuation system according to claim 8, further comprising:

additional secondary piping by which the fluid supplied from the pump is pumped to the remote servo valve; and additional tertiary piping by which the fluid supplied from the pump is returned thereto from the remote servo valve.

10. The gas turbine engine actuation system according to claim 8, wherein the orifice is sized for a non-minimal pressure differential between the first and second sections.

* * * * *